US011951381B2

(12) United States Patent
Owen

(10) Patent No.: US 11,951,381 B2
(45) Date of Patent: Apr. 9, 2024

(54) TRANSFORMABLE SKATE

(71) Applicant: Anita Wu, Dongguan (CN)

(72) Inventor: Neil Owen, Dongguan (CN)

(73) Assignee: Anita Wu, Dongguan (CN)

( * ) Notice: Subject to any disclaimer, the term of this patent is extended or adjusted under 35 U.S.C. 154(b) by 0 days.

(21) Appl. No.: 17/885,056

(22) Filed: Aug. 10, 2022

(65) Prior Publication Data

US 2024/0050835 A1 Feb. 15, 2024

(51) Int. Cl.
*A63C 17/00* (2006.01)

(52) U.S. Cl.
CPC ..... *A63C 17/0073* (2013.01)

(58) Field of Classification Search
CPC ..... A63C 17/02; A63C 17/0073
See application file for complete search history.

(56) References Cited

U.S. PATENT DOCUMENTS 177,566 A * 5/1876 Saladee ..... A63C 17/02 280/11.19
6,213,479 B1 * 4/2001 Cochimin ..... A63C 17/06 280/11.221
6,322,088 B1 * 11/2001 Klamer ..... A63C 17/02 280/7.1
8,844,946 B2 * 9/2014 Lorelli ..... A63C 17/067 280/11.19
2010/0007105 A1 * 1/2010 Cares ..... A63C 17/1436 280/11.223
2022/0288482 A1 * 9/2022 Cheng ..... A63C 17/0073

FOREIGN PATENT DOCUMENTS

CN 2335677 Y * 9/1999
CN 112451954 A * 3/2021 ..... A63C 17/02
DE 20211933 U1 * 10/2002 ..... A43B 5/1633

* cited by examiner

*Primary Examiner* — James A Shriver, II
*Assistant Examiner* — Michael T. Walsh
(74) *Attorney, Agent, or Firm* — Muncy, Geissler, Olds & Lowe, P.C.

(57) ABSTRACT

A transformable skate is provided, including: a shoe body; a frame, connected to the shoe body; at least one first fork support, connected to the frame on which at least one first wheel is mounted; and an adjustable assembly, including a base and at least two second fork supports on which at least two second wheels are respectively mounted, the base being adjustably positioned to and blocked by the frame and the at least two second fork supports being each adjustably positioned to and blocked by the base so that the at least two second fork supports are constructed and arranged to position the at least two second wheels in an inline arrangement or in a parallel arrangement.

8 Claims, 10 Drawing Sheets

TRANSFORMABLE SKATE

BACKGROUND OF THE INVENTION

Field of the Invention

The present invention relates to a transformable skate.

Description of the Prior Art

Skates having wheels are broadly used for sporting, exercising, and recreational activities. Inline skates and parallel skates are the most popular. In the conventional skate, the wheels are generally fixedly secured to the bottom of the shoe portion and not adjustable. In other words, configurations of the inline skate and the parallel skate are generally not interchangeable.

Besides, it is not easy, especially to a beginner in skating, to balance on the inline skate or parallel skate, and it is therefore hard to learn and the beginner might get injury easily.

The present invention is, therefore, arisen to obviate or at least mitigate the above-mentioned disadvantages.

SUMMARY OF THE INVENTION

The main object of the present invention is to provide a transformable skate which can be selectively transformed into either of two varieties of skates.

To achieve the above and other objects, a transformable skate is provided, including: a shoe body; a frame, connected to the shoe body; at least one first fork support, connected to the frame on which at least one first wheel is mounted; and an adjustable assembly, including a base and at least two second fork supports on which at least two second wheels are respectively mounted, the base being adjustably positioned to and blocked by the frame and the at least two second fork supports being each adjustably positioned to and blocked by the base so that the at least two second fork supports are constructed and arranged to position the at least two second wheels in an inline arrangement or in a parallel arrangement.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
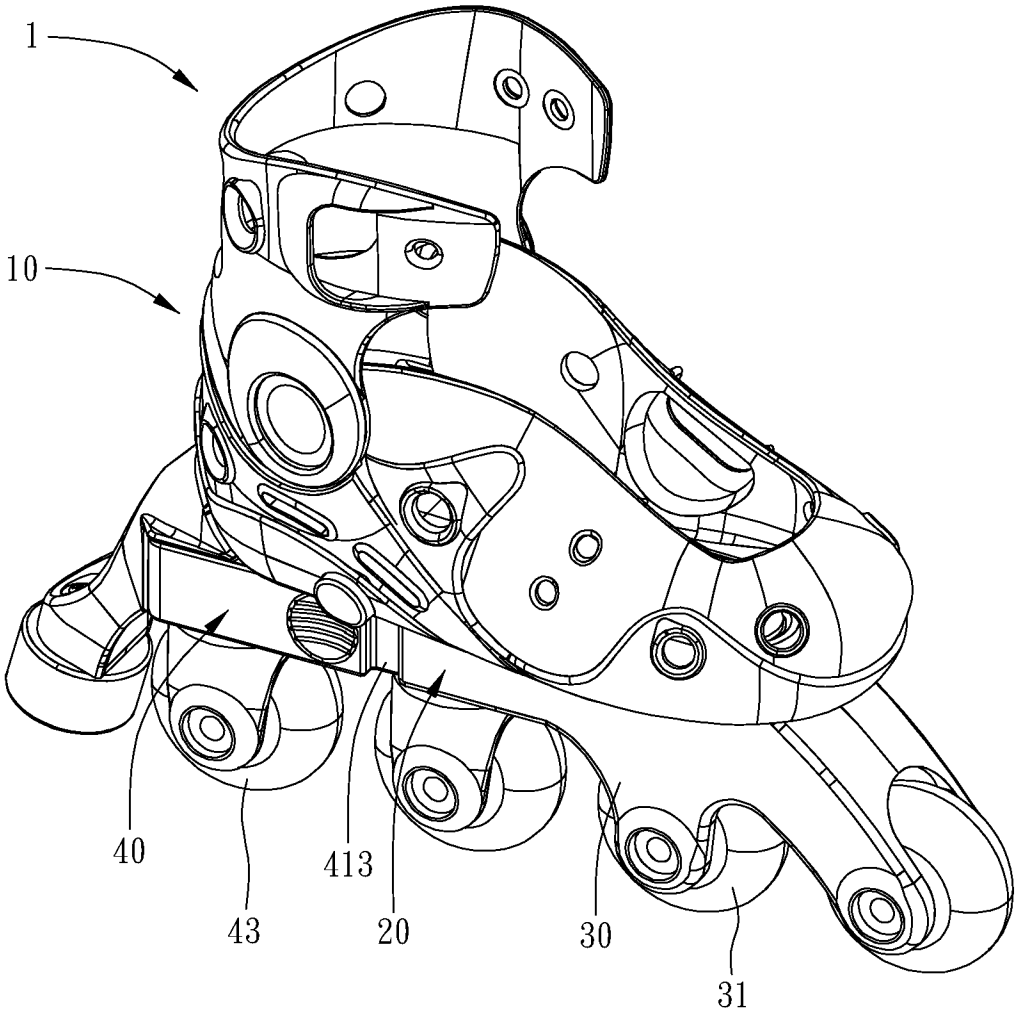
FIG. 1 is a stereogram an isometric view of a transformable skate in an inline arrangement according to a preferable embodiment of the present invention.
Figure 2:
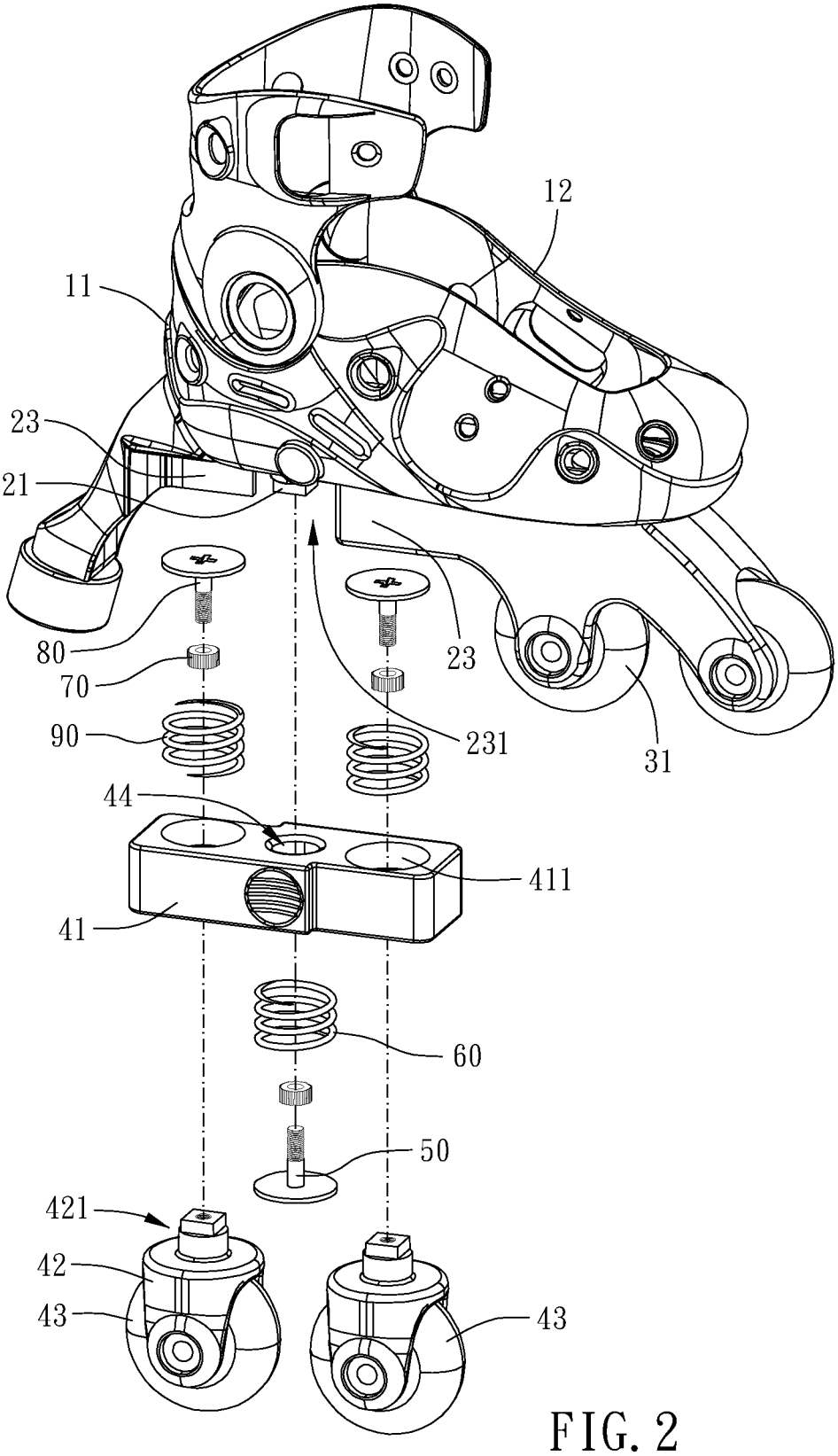
FIG. 2 is a breakdown drawing of a preferable embodiment of the present invention.
Figure 3:
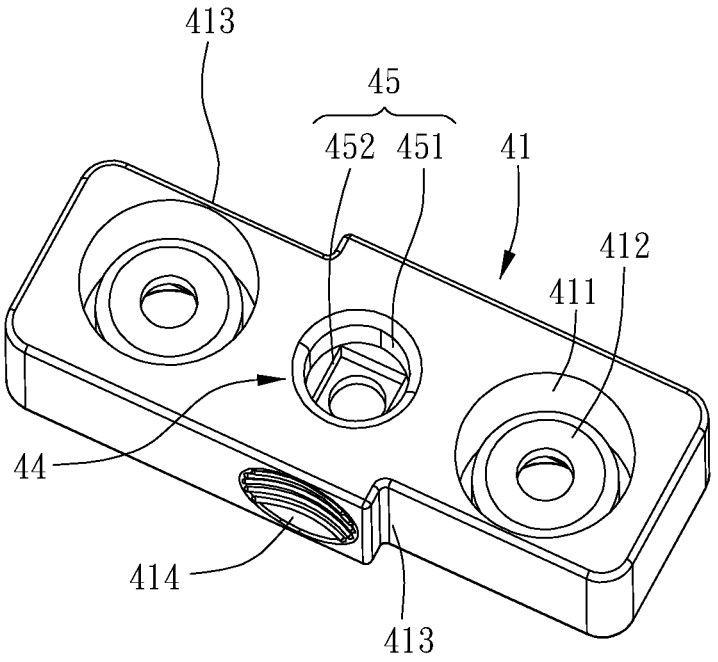
FIGS. 3 and 4 are drawings showing a base of an adjustable assembly according to a preferable embodiment of the present invention.
Figure 4:
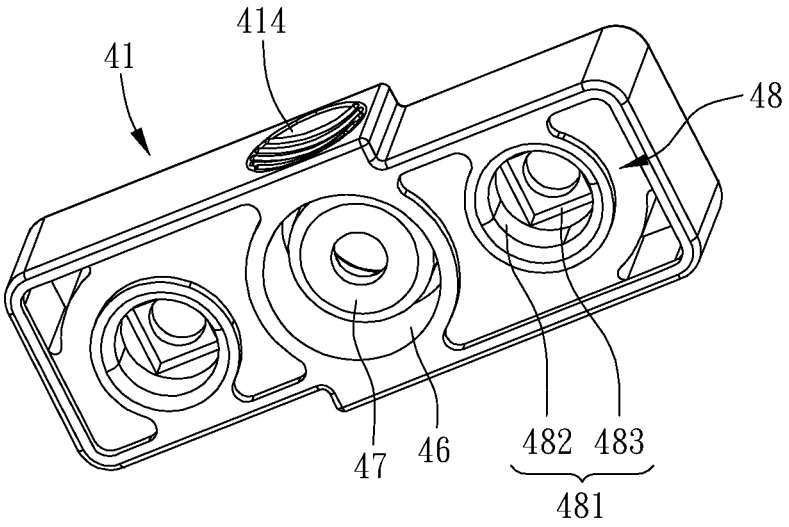
Figure 5:
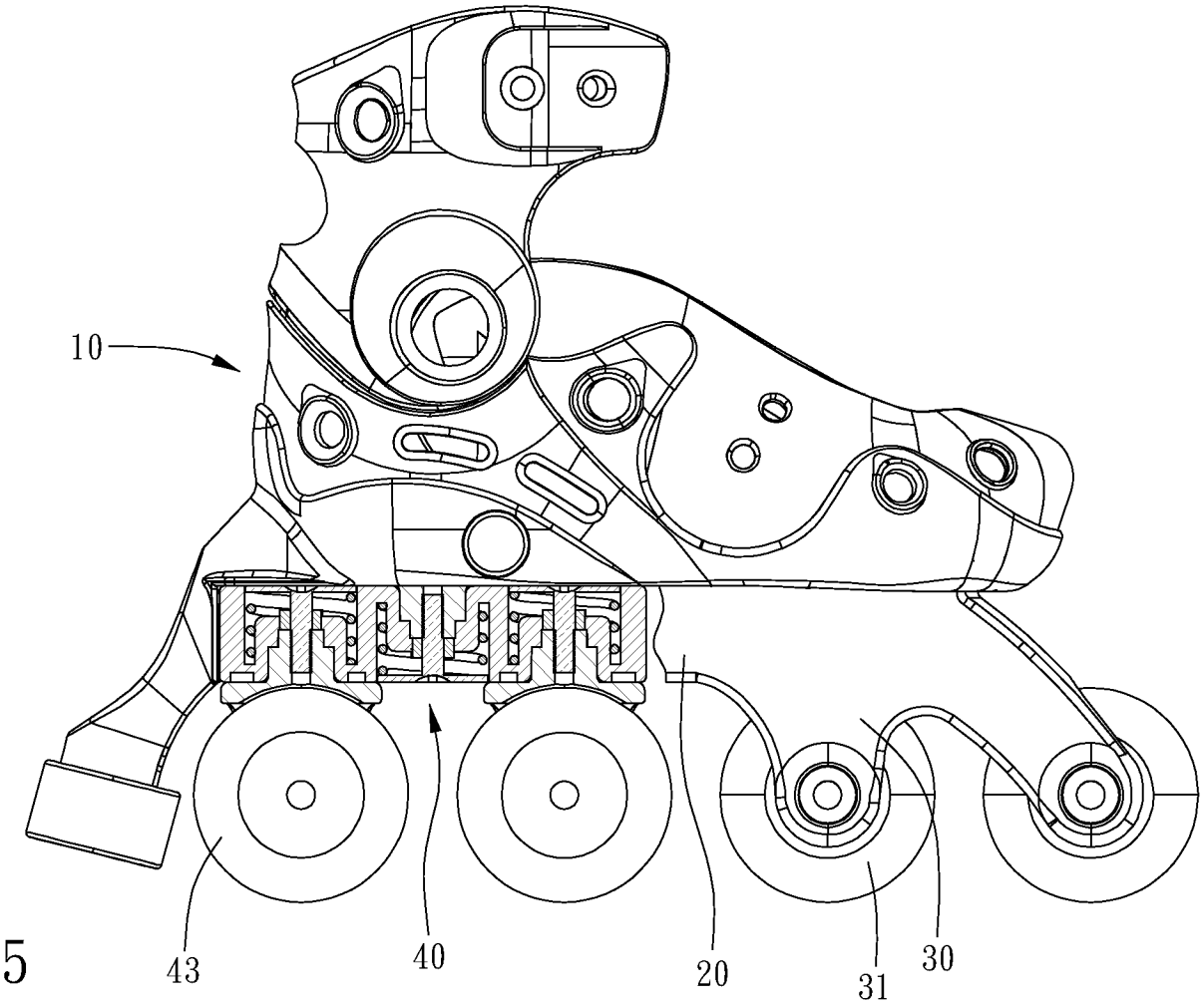
FIG. 5 is a side view of a preferable embodiment of the present invention.
Figure 6:
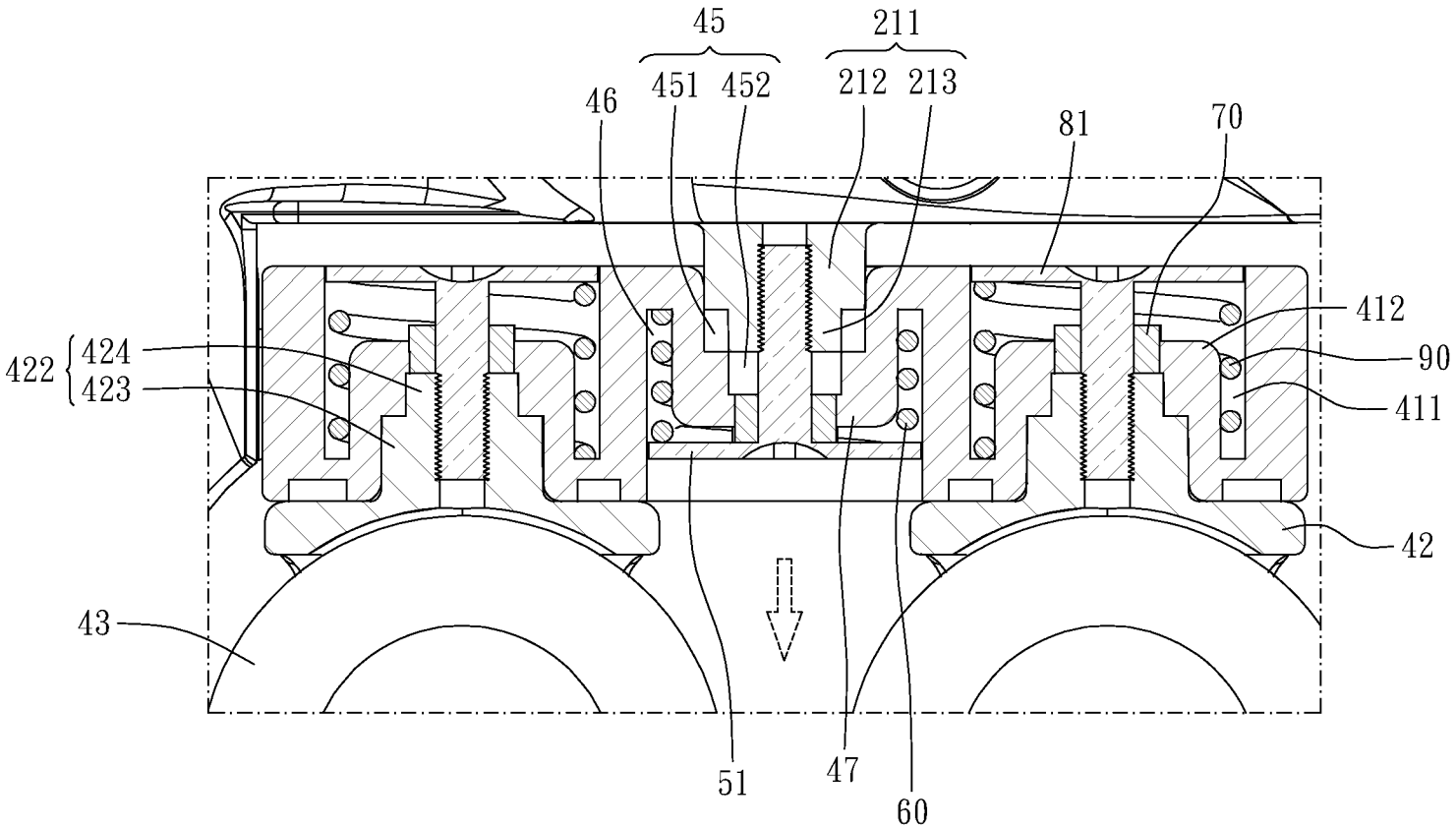
FIGS. 6 and 7 are drawings showing operation of the base of the adjustable assembly according to a preferable embodiment of the present invention.
Figure 7:
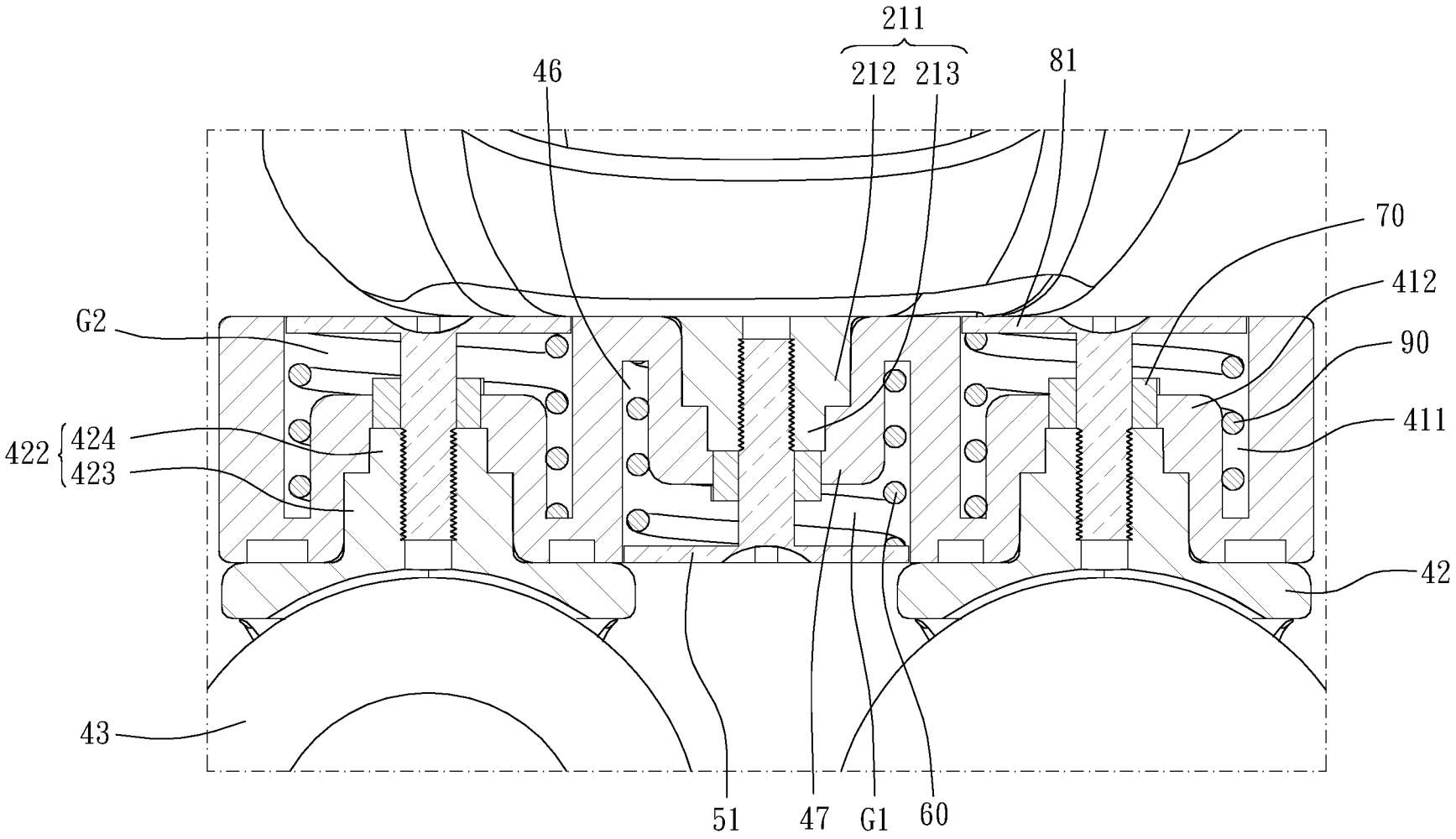
Figure 8:
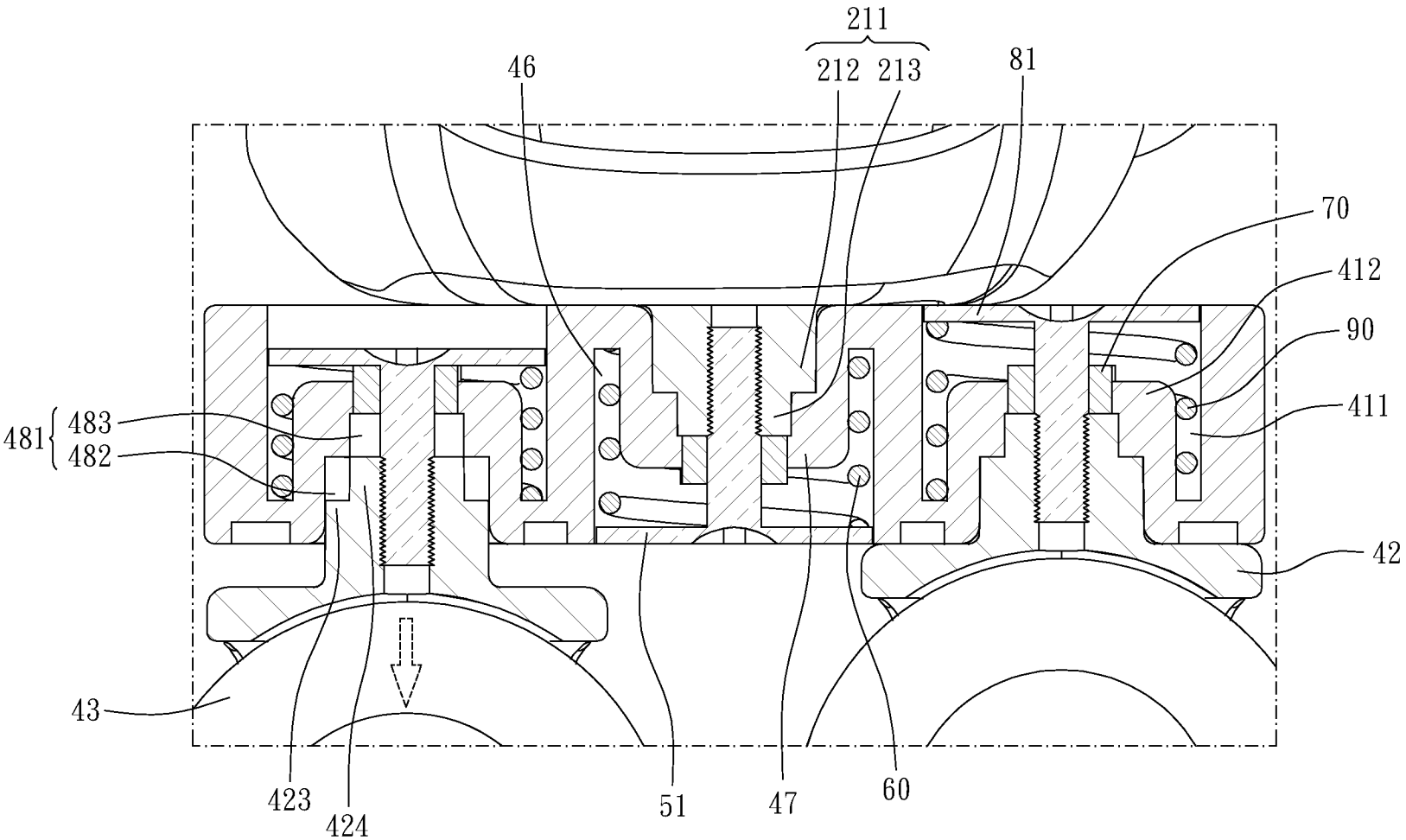
FIGS. 8 and 9 are drawings showing operation of a second fork support of the adjustable assembly according to a preferable embodiment of the present invention.
Figure 9:
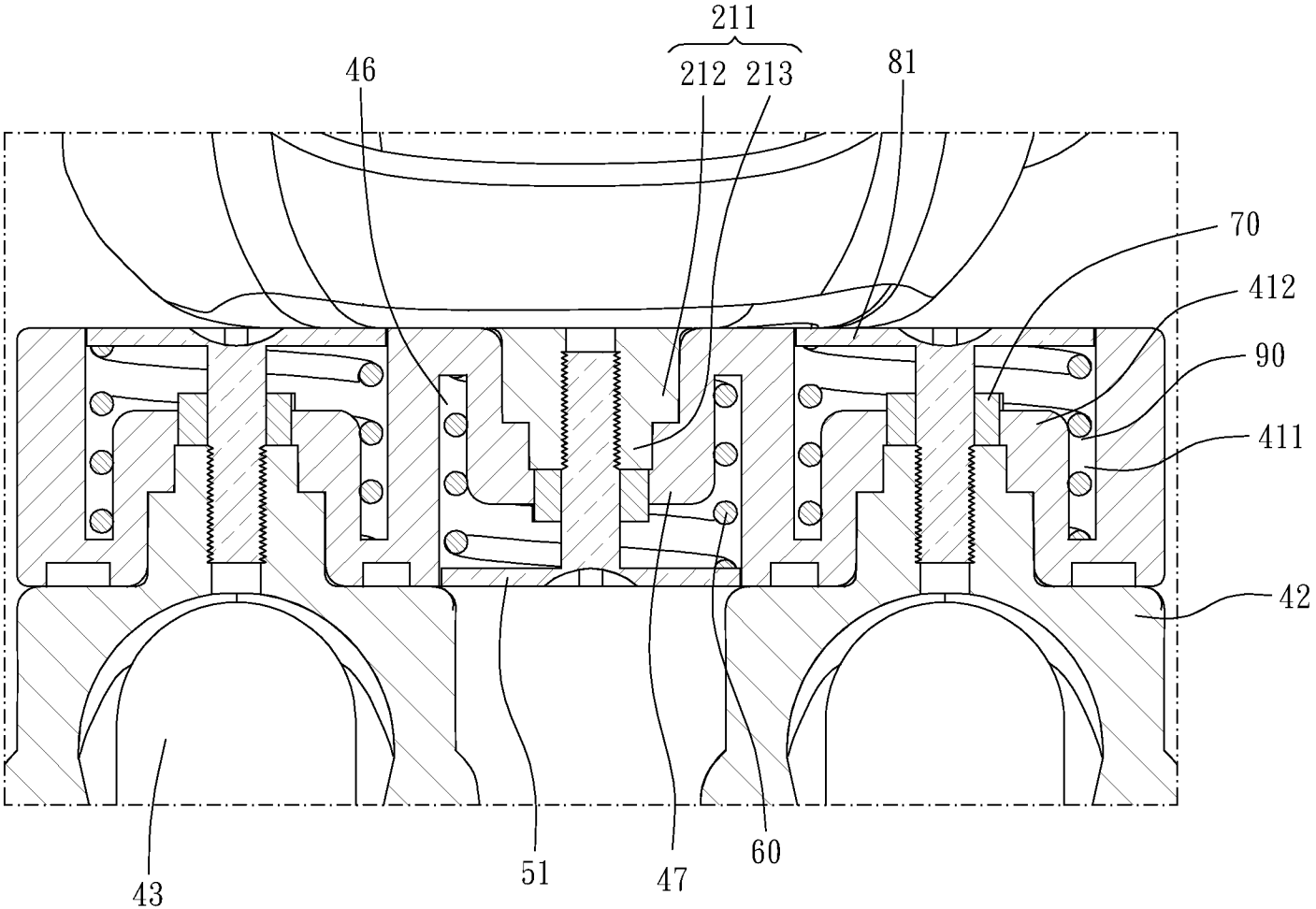

Please refer to FIGS. 1 to 11 for a preferable embodiment of the present invention. A transformable skate 1 of the present invention includes a shoe body 10, a frame 20, at least one first fork support 30 and an adjustable assembly 40.

The frame 20 is connected to the shoe body 10. The at least one first fork support 30 is connected to the frame 20 on which at least one first wheel 31 is mounted. The adjustable assembly 40 includes a base 41 and at least two second fork supports 42 on which at least two second wheels 43 are respectively mounted. The base 41 is adjustably positioned to and blocked by the frame 20 and the at least two second fork supports 42 are each adjustably positioned to and blocked by the base 41 so that the at least two second fork supports 42 are constructed and arranged to position the at least two second wheels 43 in an inline arrangement or in a parallel arrangement. It is noted that, in other embodiments, the transformable skate 1 includes at least two first fork supports 30 and at least two first wheels 31, and the at least two first fork supports 30 may be constructed in a similar or same arrangement as the arrangement of the at least two second fork supports 42 and the at least two second wheels 43 so that it is also adjustable. As such, the transformable skate 1 may be selectively transformed into one of an inline mode (FIG. 1), tri-mode (FIG. 10) and quad mode.

In this embodiment, a first portion 11 of the shoe body 10 and the frame 20 are formed of one piece, and a second portion 12 of the shoe body 10 is assembled to the frame 20 and the first portion 11. In other embodiments, the first portion 11 may be detachably connected to the frame 20.

The frame 20 includes a first connection structure 21, the base 41 includes a second connection structure 44, one of the first and second connection structures 21, 44 includes an insertion hole 45 including a first section 451 and a second section 452 which is non-circular, and the other of the first and second connection structures 21, 44 includes an insertion column 211 including a first shaft part 212 received in the first section 451 and a second shaft part 213 which is non-circular and non-rotatably received in the second section 452. The insertion column 211 is retreatable from the insertion hole 45 to disengage the second shaft part 213 from the second section 452 (FIG. 6) so that the base 41 is rotatably adjustable relative to the frame 20.

In this embodiment, the first connection structure 21 includes the insertion column 211, and the second connection structure 44 includes the insertion hole 45. The first shaft part 212 has a length of about 7.8 mm and the second shaft part 213 has a length of about 4.0 mm, which provides a reliable combination and sufficient structural strength. The base 41 further includes a connection hole 46 and a projection 47 projecting in the connection hole 46. A fastener 50 is disposed at least through the projection 47 and connected to the first connection structure 21. A spring 60 is sleeved around the projection 47 and urged between a bottom of the connection hole 46 and an enlarged head 51 of the fastener 50 so that the second shaft part 213 is kept non-rotatably received in the second section 452 and so that there is a gap G1 between the enlarged head 51 and the base 41 for axial movement of the base 41 relative to the first connection structure 21. In this embodiment, the connection hole 46 is about 18 mm deep, the spring 60 is a coil spring having a diameter of about 24 mm and having a length of about 26 mm before pressed. It is noted that the dimensions mentioned the above are exemplary but not limited thereto.

Each of the at least two second fork supports 42 includes a first coupling structure 421, the base 41 further includes a second coupling structure 48, one of the first and second coupling structures 421, 48 includes a receiving hole 481 including a first region 482 and a second region 483 which is non-circular, and the other of the first and second coupling structures 421, 48 includes a coupling column 422 including a first post part 423 received in the first region 482 and a second post part 424 which is non-circular and non-rotatably received in the second region 483. In this embodiment, the first coupling structure 421 includes the coupling column 422, and the second coupling structure 48 includes the receiving hole 481. The coupling column 422 is retreatable from the receiving hole 45 to disengage the second post part 424 from the second region 483 so that the each of the at least two second fork supports 42 is rotatably adjustable relative to base 41.

The base 41 further includes at least two mounting holes 411 each corresponding to the first coupling structure 421 of each of the at least two second fork supports 42, and the base 41 further includes at least two projections 412 projecting in the at least two mounting holes 411, respectively. Preferably, at least two spacers 70 are connected to the at least two projections 412, respectively; at least two fasteners 80 are disposed at least through the at least two projections 412 and connected to the at least two second fork supports 42, respectively; and at least two springs 90 are sleeved around the at least two projections 412 and urged between bottoms of the at least two mounting holes 411 and enlarged heads 81 of the at least two fasteners 80, respectively, so that the second post part 424 is kept non-rotatably received in the second region 483 and so that there is a gap G2 between each of the enlarged heads 81 of the at least two fasteners 80 and each of the at least two projections 412 for axial movement of each of the at least two second fork supports 42 relative to the second coupling structures 48. The spacers 70 are configured to control the lengths of the at least two springs 90 and the resiliency so that the at least two second fork supports 42 can be effectively positioned.

Figure 10:
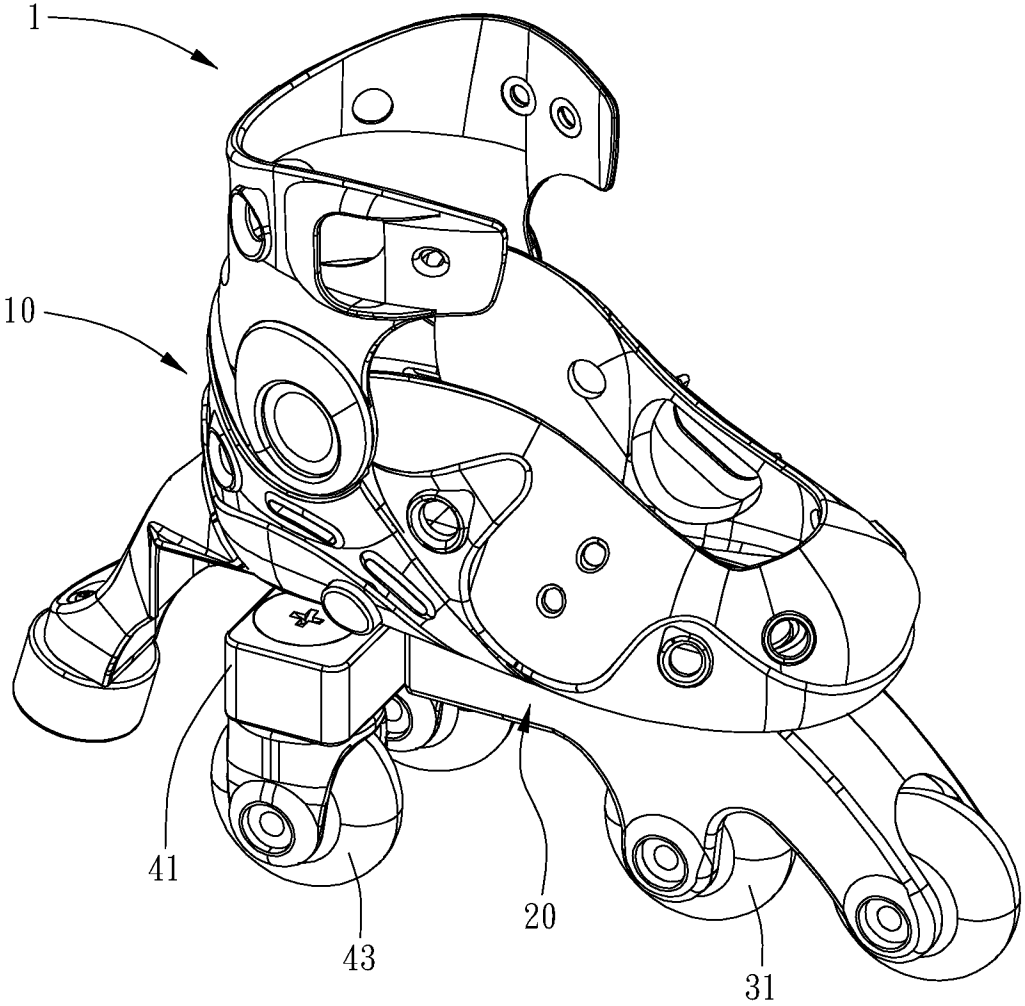
FIG. 10 is a stereogram an isometric view of the transformable skate in a parallel arrangement according to a preferable embodiment of the present invention.
Figure 11:
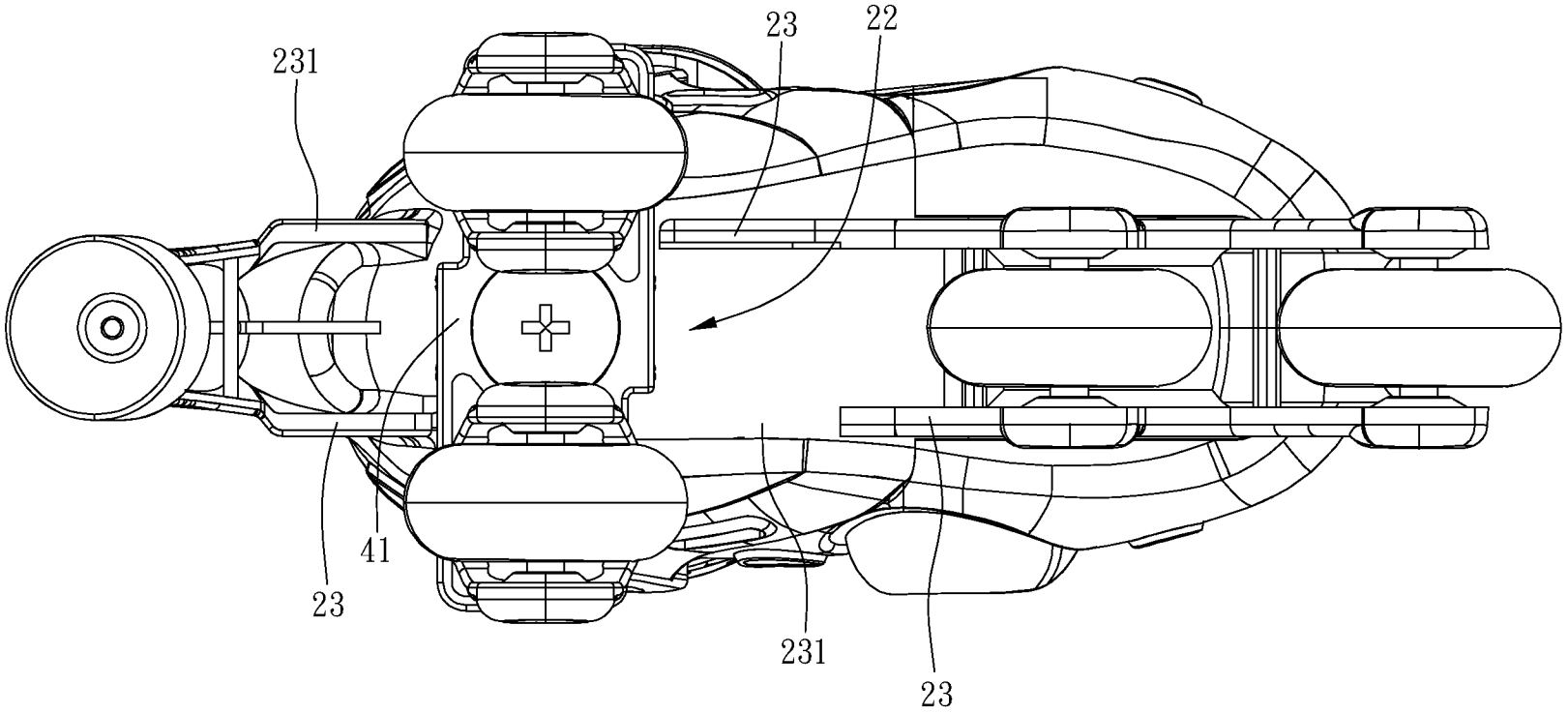
FIG. 11 is a bottom view of a preferable embodiment of the present invention.

Specifically, the frame 20 includes a room 22 and two side walls 23 at opposing sides of the room 22, the two side walls 23 each include an opening 231, and the openings 231 of the two side walls 23 are arranged diagonally. The base 41 is received within the room 22, which reduces the total thickness of the frame 20 and the base 41. When the at least two second wheels 43 are in the inline arrangement, opposing ends of the base 41 at which the at least two second fork supports 42 are mounted are received in the room 22 (FIG. 1). When the at least two second wheels 43 are in the parallel arrangement, the opposing ends of the base 41 are laterally protrusive out beyond the room 22 and the at least two second wheels 43 are located outside the room 22 (FIGS. 10 and 11). The side walls 23 can serve as stops to avoid over rotation of the base 41 and can help the relative orientation of the second post part 424 and the second region 483.

Preferably, the base 41 further includes two recesses 413 which are diagonally arranged on opposing sides of the base 41; when the at least two second wheels 43 are in the inline arrangement, the two side walls 23 are partially received in the two recesses 413, respectively, and the opposing sides of the base 41 are substantially aligned with opposing sides of the frame 20, respectively (FIG. 1). Preferably, the opposing sides of the base 41 each include a pinch concave 414 arranged radially corresponding to the second connection structure 44. The pinch concave 414 is configured for better gripping and easy operation of the base 41.

Operation of the adjustable assembly 40 includes following steps of: retreating the base 41 to disengage the second shaft part 213 from the second section 452 (FIG. 6); turning the base 41 90 degrees and fitting the second shaft part 213 into the second section 452 by means of the spring 60 (FIG. 7); retreating respective ones of the at least two second fork supports 42 to disengage the second post part 424 from the second region 483 (FIG. 8); turning respective ones of the at least two second fork supports 42 90 degrees and fitting the second post part 424 into the second region 483 by means of the spring 90 (FIG. 9) so that the at least two second wheels 43 are in the inline arrangement (inline mode) or in the parallel arrangement (tri-mode).

For a beginner in skating, the transformable skate 1 can be transformed in tri-mode easily and quickly, which is easy to balance and play, and which avoids injury caused by falling. After being proficient, the user can transform the transformable skate 1 into the inline mode for skating, so there is no need to purchase another inline skate.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A transformable skate, including:

a shoe body;

a frame, connected to the shoe body;

at least one first fork support, connected to the frame on which at least one first wheel is mounted; and an adjustable assembly, including a base and at least two second fork supports on which at least two second wheels are respectively mounted, the base being adjustably positioned to and blocked by the frame and the at least two second fork supports being each adjustably positioned to and blocked by the base so that the at least two second fork supports are constructed and arranged to position the at least two second wheels in an inline arrangement or in a parallel arrangement;

wherein the frame includes a room and two side walls at opposing sides of the room and projecting from a bottom surface of the room, the two side walls each include an opening, the openings of the two side walls are arranged diagonally and laterally open at opposing sides of the frame, and the base is received in the room and between the two side walls;

wherein the frame includes a first connection structure, the base includes a second connection structure, the second connection structure includes only one insertion hole including a first section and a second section which is non-circular, the first connection structure includes only one insertion column received in the insertion hole and including a first shaft part and a second shaft part which is non-circular, the insertion column projects from the bottom surface of the room, the bottom surface of the room is connected between the two side walls, when the second shaft part is non-rotatably received in the second section, the base is non-rotatable about the insertion column, and by directly moving the base away from the bottom surface of the room the insertion hole moves axially relative to the insertion column to disengage the second shaft part from the second section so that the base is rotatable about the insertion column;

wherein a fastener is disposed through the base and connected to the first connection structure, a spring is disposed and urged between the base and an enlarged head of the fastener, the base is biased by the spring toward the bottom surface of the room so that the second shaft part is kept non-rotatably received in the second section and so that there is a gap between the enlarged head and the base for axial movement of the base relative to the first connection structure;

wherein when the at least two second wheels are in the parallel arrangement, the base projects, via the openings of the two side walls, laterally out beyond the room, the two side walls, the frame and opposing outmost sides of the shoe body.

2. The transformable skate of claim 1, wherein a first portion of the shoe body and the frame are formed of one piece, and a second portion of the shoe body is assembled to the frame and the first portion.

3. The transformable skate of claim 1, wherein the base further includes a connection hole, and the base further includes a projection projecting in the connection hole; the fastener is disposed at least through the projection and connected to the first connection structure; and the spring is sleeved around the projection and urged between a bottom of the connection hole and the enlarged head of the fastener, and the gap is between the enlarged head and the projection.

4. The transformable skate of claim 1, wherein each of the at least two second fork supports includes a first coupling structure, the base includes a second coupling structure, one of the first and second coupling structures includes a receiving hole including a first region and a second region which is non-circular, the other of the first and second coupling structures includes a coupling column including a first post part received in the first region and a second post part which is non-circular, when the second post part is non-rotatably received in the second region, each of the at least two second fork supports is non-rotatable about the second coupling structure, and by directly moving the each of the at least two second fork supports away from the base the coupling column is axially movable relative to the receiving hole to disengage the second post part from the second region so that each of the at least two second fork supports is rotatable about second coupling structure.

5. The transformable skate of claim 4, wherein the base includes at least two mounting holes each corresponding to the first coupling structure of each of the at least two second fork supports; the base further includes at least two projections projecting in the at least two mounting holes, respectively; at least two spacers are connected to the at least two projections, respectively; at least two fasteners are disposed at least through the at least two projections and connected to the at least two second fork supports, respectively; at least two springs are sleeved around the at least two projections and urged between bottoms of the at least two mounting holes and enlarged heads of the at least two fasteners, respectively; the enlarged heads of the at least two fasteners are biased by the at least two springs toward the bottom surface of the room so that the second post part is kept non-rotatably received in the second region and so that there is a gap between each of the enlarged heads of the at least two fasteners and each of the at least two projections for axial movement of each of the at least two second fork supports relative to the second coupling structures.

6. The transformable skate of claim 1, wherein when the at least two second wheels are in the inline arrangement, opposing ends of the base at which the at least two second fork supports are mounted are received in the room; and when the at least two second wheels are in the parallel arrangement, the opposing ends of the base are laterally protrusive out beyond the room, and the at least two second wheels are located entirely outside the room frame.

7. The transformable skate of claim 1, wherein the base further includes two recesses which are diagonally arranged on opposing sides of the base; when the at least two second wheels are in the inline arrangement, the two side walls are partially received in the two recesses, respectively, and the opposing sides of the base are substantially aligned with the opposing sides of the frame, respectively.

8. The transformable skate of claim 1, wherein opposing sides of the base each include a pinch concave arranged radially corresponding to the second connection structure.

* * * * *